US010640907B2

(12) United States Patent
Pillot et al.

(10) Patent No.: US 10,640,907 B2
(45) Date of Patent: May 5, 2020

(54) LAUNDRY TREATMENT MACHINE

(71) Applicant: Electrolux Appliances Aktiebolag, Stockholm (SE)

(72) Inventors: Sergio Pillot, Pordenone (IT); Luca Gruppo, Porcia (IT); Calum Armstrong, Montereale Valcellina (IT); Levente Szabo, Pordenone (IT); Daniele Striato, Pordenone (IT); Luca Pradal, San Vito di Fagagna (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 778 days.

(21) Appl. No.: 14/915,319

(22) PCT Filed: Aug. 26, 2014

(86) PCT No.: PCT/EP2014/068043

§ 371 (c)(1),
(2) Date: Feb. 29, 2016

(87) PCT Pub. No.: WO2015/028452

PCT Pub. Date: Mar. 5, 2015

(65) Prior Publication Data

US 2016/0208427 A1 Jul. 21, 2016

(30) Foreign Application Priority Data

Aug. 30, 2013 (EP) ..... 13182528
Aug. 30, 2013 (EP) ..... 13182529

(51) Int. Cl.
*D06F 37/26* (2006.01)
*D06F 37/28* (2006.01)
(Continued)

(52) U.S. Cl.
CPC ..... *D06F 37/264* (2013.01); *D06F 37/28* (2013.01); *D06F 39/14* (2013.01); *D06F 58/20* (2013.01)

(58) Field of Classification Search
CPC ..... D06F 37/264; D06F 37/28; D06F 39/14; D06F 58/20
(Continued)

(56) References Cited

U.S. PATENT DOCUMENTS 8,661,859 B2 3/2014 Choi
8,661,860 B2 3/2014 Murrell et al.
(Continued)

FOREIGN PATENT DOCUMENTS

CN 201103057 Y 8/2008
CN 101570926 A 11/2009
(Continued)

OTHER PUBLICATIONS

Chinese Office Action for Chinese Application No. 201480048087.8, dated Jan. 19, 2018, including English translation, 21 pages.
(Continued)

*Primary Examiner* — Levon J Shahinian
(74) *Attorney, Agent, or Firm* — RatnerPrestia

(57) ABSTRACT

A laundry machine (1) having cabinet (2) housing a chamber (3) for treating laundry having a rotation axis (RR), a porthole (8) for providing access to and tightly closing the chamber (3), a hinge (11) to pivot the porthole (8) to the cabinet (2), an electromechanical lock (12) having a first member (13) on the porthole (8) and a matching member (14) on the cabinet (2), and a grip-only handle (15). The porthole (8) has at least one frame (30, 30*a*, 31), and a glass (32) secured to the at least one frame (30, 30*a*, 31). The electromechanical lock (12) is configured to be released by applying a force beyond a threshold onto the porthole (8) away from the cabinet (2). The grip-only handle (15) and the first member (13) of the electromechanical lock (12) may be arranged in such a way that, when the porthole (8) is closed, the center of mass of the grip-only handle (15) and the center of mass of the first member (13) of the electromechanical lock (12) are located, with respect to the rotation axis (RR), at different angular positions. The grip-only handle (15*b*, 15*c*) may be configured to be alternatively positionable in one of at least two prefixed positions with respect to the frame assembly.

15 Claims, 13 Drawing Sheets

(51) Int. Cl.
*D06F 39/14* (2006.01)
*D06F 58/20* (2006.01)

(58) Field of Classification Search
USPC ..... 68/12.26, 196, 212
See application file for complete search history.

(56) References Cited

U.S. PATENT DOCUMENTS

| | | | | |
|---|---|---|---|---|
| 2004/0244435 | A1* | 12/2004 | Kim | D06F 39/14<br>68/12.26 |
| 2009/0230371 | A1 | 9/2009 | Cook et al. | |
| 2011/0023561 | A1 | 2/2011 | Murrell et al. | |

FOREIGN PATENT DOCUMENTS

| | | | |
|---|---|---|---|
| CN | 201826155 | U | 5/2011 |
| CN | 102471977 | A | 5/2012 |
| DE | 102012107474 | A1 | 2/2013 |
| DE | 202013000222 | U1 | 3/2013 |
| DE | 102012202745 | A1 | 8/2013 |
| EP | 2402499 | A1 | 1/2012 |

OTHER PUBLICATIONS

Nov. 28, 2016—(CN) Notification of the First Office Action—App 201480048087.8.
International Search Report dated Dec. 19, 2014 in corresponding International Application No. PCT/EP2014/068043.
Communication Pursuant to Article 94(3) for European Application No. 13 182 529.1, dated Mar. 18, 2019, 5 pages.

* cited by examiner

LAUNDRY TREATMENT MACHINE

FIELD

The present invention relates to a laundry treatment machine (or laundry machine) for washing and/or drying laundry.

In the present application, the laundry machine can be a laundry washing machine (or simply washing machine) or a laundry dryer (or simply dryer) or a laundry washing-drying machine (or simply washer/dryer, i.e. a laundry machine which can both wash and dry the goods or laundry).

BACKGROUND

A laundry treatment machine typically includes a cabinet wherein the processing chamber for housing the laundry to be treated is housed, and a door or porthole for providing access to and tightly closing the chamber. In the case of a washing machine or a washer/dryer, the chamber is usually a drum, rotatably mounted within a washing tub. In the case of a dryer, the chamber is usually a rotatable drum, there being air circulation ducts, a heater, and a blower for circulating heated air in the ducts and in the chamber.

A kind of porthole for laundry treatment machines which is of interest herein comprises an outer frame, an inner frame, and a glass sandwiched between the outer and inner frames. In the case of a circular porthole, the inner and outer frames are generally annular.

As used in the present description and in the attached claims, terms "outer" and "inner", and "outwards" and "inwards" refer to the cabinet or the laundry treatment machine, and in the closed condition as far as the porthole is concerned.

Terms "radial", "radially inner" and "radially outer" refer to the axis of rotation of the processing chamber, when the porthole is closed.

The glass is generally cup-shaped, having a flange retained between the frames, and protruding towards the inner of the laundry machine. An essentially disc shaped cap, e.g. made of transparent plastics, and/or a finishing rim may also be provided.

The porthole is typically hinged to the cabinet, so as to rotate (usually about a vertical axis), the hinge being usually arranged across a horizontal centerline or median plane of the porthole.

The porthole usually has a handle to be gripped by a user.

The porthole usually has an electromechanical lock. The electromechanical lock is usually configured to avoid opening of the porthole during operation of the machine; and to possibly avoid operation of the machine with the porthole open, by issuing a consent signal to an electronic control unit of the machine only when the porthole is closed and/or to delay opening of the porthole after the end of an operation cycle. The electromechanical lock is therefore also an interlock.

There are two major classes of door (or porthole) opening systems. In a first class, the porthole is provided with a hook that is moved by pivoting the handle with respect to the porthole, and the cabinet is provided with an opening that is engaged by the hook on the porthole in a closed condition, not engaged in an open or released condition. The portholes of this type suffer from the important drawback that they cannot be opened from inside the processing chamber (for example by a child who has entered the chamber and has closed the door), since their opening requires pivoting the handle (which can be clearly made only from outside the processing chamber).

In the second class of door opening systems, to which the invention is directed, and which may be named "pull-to-open type" door opening system, the porthole is provided with a latch, and the cabinet is provided with a latch retaining mechanism that includes a mobile part which is configured to be movable between a retaining position, in which it engages the latch so as to retain the porthole in a closed condition, and an opening position in which it releases the latch so as to allow the opening of the porthole. The mobile part of the latch retaining mechanism typically interacts with an elastic element, for example a spring, which allows the releasing of the latch when a releasing force is applied which is greater than a threshold force. The porthole is therefore opened by pulling it outwards with enough force, and can also be opened by pushing it from the inside of the drum, e.g. by a caught child.

Alternatively, the latch may be provided in the cabinet and the latch retaining mechanism may be provided in the porthole.

In the case of this second class, the handle of the porthole has only the function of providing a grip to the user, it is fixed to the outer frame of the porthole, and it is typically symmetrical with respect to the latch.

SUMMARY OF SELECTED INVENTIVE ASPECTS

An object of aspects of invention is to improve a grip-only handle of a porthole of a laundry machine having a pull-to-open door opening systems.

Applicant found that the above object is achieved by arranging the electromechanical lock and the grip-only handle at different positions with respect to at least a door frame to which a glass of the door is secured.

In a first aspect, the invention relates to a laundry machine comprising a cabinet housing a chamber for treating laundry having a rotation axis, a porthole for providing access to and tightly closing the chamber, a hinge to pivot the porthole to the cabinet, an electromechanical lock comprising a first member on the porthole and a matching member on the cabinet, and a grip-only handle, wherein said porthole comprises at least one frame and a glass secured to the at least one frame, wherein said electromechanical lock is configured to be released by applying a force beyond a threshold onto the porthole away from the cabinet, wherein said grip-only handle and said first member of said electromechanical lock are arranged in such a way that, when the porthole is closed, the center of mass of said grip-only handle and the center of mass of said first member of said electromechanical lock are located, with respect to the rotation axis, at different angular positions.

In the present description and in the attached claims, the "angular position" refers to the rotation axis of the chamber for treating laundry.

In the present description and in the attached claims, the expression that the centers of mass are "located at different angular positions" means that the centers of mass belong to different half planes each starting from the rotation axis.

In the present description and in the attached claims, "glass" has to be read as a protective element supported by the one or more frames of the porthole and having the function, together with the rest of the porthole, of tightly closing the processing chamber of the machine; therefore the glass may be actually made of glass, but also of different material (e.g. plastic material), and it may be transparent, opaque, or partially transparent.

The described arrangement allows increasing the degree of freedom in designing the grip-only handle by relieving the constraints that would be imposed by the presence, at the frame of the porthole, of the first member of the electromechanical lock at the same position as the handle.

Preferably said at least one frame comprises an outer frame and an inner frame and said glass is sandwiched between the outer frame and the inner frame.

Preferably said hinge is arranged in such a way that, when the porthole is closed, its center of mass is located, with respect to the rotation axis, at a diametrically opposite angular position with respect to the center of mass of said first member of said electromechanical lock.

In the present description and in the attached claims, the expression that the centers of mass are "located at diametrically opposite angular positions" means that the centers of mass belong to a same plane containing also the rotation axis, and are located on the two different half planes thereof starting from the rotation axis.

The arrangement of the electromechanical lock diametrically opposite the hinge provides a uniform distribution of the efforts, including the weight of the porthole and the compression resistance of a gasket (if any), provided between the porthole and the border of the loading/unloading opening in the cabinet closed by the porthole. The tightness of the chamber when closed by the porthole is also maximized by the arrangement of the electromechanical lock diametrically opposite the hinge.

Preferably said grip-only handle and said first member of said electromechanical lock are arranged in such a way that, when the porthole is closed, their centers of mass are located, with respect to the rotation axis, at angular positions that are reciprocally spaced by less than 90°.

This means that said grip-only handle is arranged in the half of the porthole about the electromechanical lock. This reduces the effort of the user to pull open the porthole.

Preferably when the laundry machine is arranged on a horizontal supporting plane, the hinge and electromechanical lock are each located across and preferably centered across a horizontal median plane of the porthole, and are diametrically opposite to each other with respect to the rotation axis when the porthole is closed, and the grip-only handle is located outside of the horizontal median plane.

This is ergonomically the best position for the user, who reaches the handle from above or respectively from below, depending on whether the laundry machine is mounted on the floor or arranged on top of another equipment or piece of furniture, like in the case of a dryer machine arranged on top of a washing machine.

Preferably the grip-only handle is configured to be alternatively positionable in one of at least two prefixed positions, more preferably alternatively in one of four prefixed positions with respect to said at least one frame.

This allows the handle to be always in the more ergonomic position, depending e.g. on whether the laundry machine is mounted on the floor or arranged on top of another equipment or piece of furniture, and/or on whether the porthole is hinged at the left or at the right, the porthole being possibly reversible.

Preferably said at least two prefixed positions are such that in any one of these prefixed positions said grip-only handle, when the porthole is closed, has a different angular position with respect to said rotation axis.

In an advantageous embodiment, the grip-only handle is one piece with said at least one frame.

In an advantageous embodiment, the grip-only handle is one piece with an annular handle support, that can be mounted in at least two different angular positions with respect to said at least one frame, so that said grip-only handle is positionable in said at least two prefixed positions by mounting said annular handle support in one of these at least two different angular positions.

The support is preferably rotatably mounted with respect to said at least one frame.

In an advantageous embodiment, the handle is provided with a coupling element and the at least one frame is provided with a matching coupling element, preferably with a plurality of matching coupling elements so that the handle can be mounted in said at least two different prefixed positions.

Preferably the grip-only handle comprises a body portion that protrudes radially inwardly from the at least one frame and extends along an arc of a circumference, there being a wall of the handle or of the at least one frame crossing the body portion at an intermediate zone of the body portion, and a plurality of reinforcing ribs extending from the body portion and the wall.

More preferably the body portion of the grip-only handle is generally flat.

In the present description and in the attached claims, "generally" or "substantially" or "essentially" means in disregard of specific instances and with regard to an overall picture.

Thus, "generally flat" means that the handle may depart slightly or locally from a flat configuration, still being prevailingly flat or essentially two-dimensional. In particular the grip-only handle may be slightly curved.

Preferably, the ribs are generally L-shaped bodies arranged at a corner between the wall and the body portion, on the inner side of the grip-only handle facing, when the porthole is closed, the chamber and/or the cabinet.

Preferably, the ribs are generally flat.

Preferably, each rib includes a long edge adjoining an inner side of the body portion from the wall towards a free edge of the body portion, more preferably up to the free edge, and a short edge adjoining at least part of the wall.

Preferably, the ribs extend parallel to each other. Alternatively, each rib extends in a radial plane.

In order to provide a particularly ergonomic handle, it may advantageously protrude radially inwardly from the at least one frame and extend along an arc of a circumference, the radial extent of the handle being not constant along said arc of a circumference and the handle comprising a zone having a first radial extent, and a zone adjacent thereto having a second radial extent smaller than the first radial extent, so that when the handle is gripped by a user, the zone having the first radial extent is gripped by the index finger and the medium finger, and the zone having the second radial extent is gripped by the ring finger and the little finger.

Preferably the grip-only handle comprises a body portion having a first edge that is an arc of circumference and adjoins the at least one frame and a free edge that: contacts the first edge at a first end of the handle, is then curved, having a radially inner convexity so that the radial extent of the handle increases to a maximum and then decreases again to a minimum greater than zero at a corner near a second end of the handle, and after the corner is straight along an almost radial direction, until it contacts the first edge at the second end of the handle.

Preferably the grip-only handle protrudes radially inwards from said at least one frame.

Preferably the grip-only handle does not protrude outwards of said at least one frame.

Preferably the hinge is located on a left side of said porthole, as seen from the outside of said laundry machine.

Applicant also found that the above object is achieved by providing a grip-only handle alternatively in one of at least two different angular positions with respect to a frame assembly of the porthole, so that it can be arranged in the more ergonomic position.

In a second aspect, the invention therefore relates to a laundry machine comprising a cabinet housing a chamber for treating laundry having a rotation axis, a porthole for providing access to and tightly closing the chamber, a hinge to pivot the porthole to the cabinet, an electromechanical lock comprising a first member on the porthole and a matching member on the cabinet, and a grip-only handle, wherein said porthole comprises a frame assembly comprising at least one frame, wherein said electromechanical lock is configured to be released by applying a force beyond a threshold onto the porthole away from the cabinet, wherein said grip-only handle is configured to be alternatively positionable in one of at least two prefixed positions with respect to said frame assembly.

This allows the handle to be always in the more ergonomic position, depending e.g. on whether the laundry machine is mounted on the floor on arranged on top of another equipment or piece of furniture, like in the case of a dryer arranged on top of a washing machine, and/or on whether the porthole is hinged at the left or at the right, the porthole being possibly reversible.

Preferably said at least two prefixed positions are such that in any one of these prefixed positions said grip-only handle, when the porthole is closed, has a different angular position with respect to said rotation axis.

In the present description and in the attached claims, the "angular position" refers to the rotation axis of the chamber for treating laundry.

Preferably the at least two prefixed positions are four prefixed positions.

In an advantageous embodiment, the handle is one piece with an annular handle support, comprised in the frame assembly, which can be mounted in at least two different angular positions with respect to the rest of the frame assembly, so that said grip-only handle is positionable in said at least two prefixed positions by mounting said annular handle support in one of these at least two different angular positions.

The support is preferably rotatably mounted with respect to the rest of the frame assembly.

In an advantageous embodiment, the handle is provided with a coupling element and the frame assembly is provided with a plurality of matching coupling elements, so that the handle can be mounted in said at least two prefixed positions.

Preferably said grip-only handle and said first member of electromechanical lock are arranged in such a way that, when the porthole is closed, their centers of mass are located, with respect to the rotation axis, at different angular positions.

The described arrangement allows increasing the degree of freedom in designing the grip-only handle by relieving the constraints that would be imposed by the presence, at the frame assembly of the porthole, of the first member of the electromechanical lock at the same position as the handle.

Preferably the frame assembly comprises an outer frame and an inner frame and a glass is sandwiched between the outer frame and the inner frame.

Preferably the hinge is arranged in such a way that, when the porthole is closed, its center of mass is located, with respect to the rotation axis, at a diametrically opposite angular position with respect to the center of mass of said first member of said electromechanical lock.

The arrangement of the electromechanical lock diametrically opposite the hinge, provides a uniform distribution of the efforts, including the weight of the porthole and the compression resistance of a gasket (if any), provided between the porthole and the border of the loading/unloading opening in the cabinet closed by the porthole. The tightness of the chamber when closed by the porthole is also maximized by the arrangement of the electromechanical lock diametrically opposite the hinge.

Preferably, said grip-only handle and said first member of said electromechanical lock are arranged in such a way that, when the porthole is closed, their centers of mass are located, with respect to the rotation axis, at angular positions that are reciprocally spaced by less than 90°.

This means that said grip-only handle is arranged in the half of the porthole about the electromechanical lock. This reduces the effort of the user to pull open the porthole.

Preferably when the laundry machine is arranged on a horizontal supporting plane, the hinge and electromechanical lock are each located across and preferably centered across a horizontal median plane of the porthole, and are diametrically opposite to each other with respect to the rotation axis when the porthole is closed, and the grip-only handle is located in one of at least two positions outside of the horizontal median plane.

This is ergonomically the best position for the user, who reaches the handle from above or respectively from below, depending on whether the laundry machine is mounted on the floor or arranged on top of another equipment or piece of furniture, like in the case of a dryer arranged on top of a washing machine.

Preferably the grip-only handle comprises a body portion that protrudes, when the grip-only handle is assembled to the frame assembly, radially inwardly from the at least one frame and extends along an arc of a circumference, there being a wall of the handle or of the at least one frame crossing the body portion at an intermediate zone of the body portion, and a plurality of reinforcing ribs extending from the body portion and the wall.

More preferably the body portion of the grip-only handle is generally flat.

Preferably, the ribs are generally L-shaped flat bodies arranged at a corner between the wall and the body portion, on the inner side of the grip-only handle facing, when the porthole is closed, the chamber and/or the cabinet.

Preferably, the ribs are generally flat.

Preferably, each rib includes a long edge adjoining an inner side of the body portion from the wall towards a free edge of the body portion, more preferably up to the free edge, and a short edge adjoining at least part of the wall.

Preferably, the ribs extend parallel to each other. Alternatively, each rib extends in a radial plane.

In order to provide a particularly ergonomic grip-only handle, it may advantageously protrude, when assembled to the frame assembly, radially inwardly from the at least one frame and extend along an arc of a circumference, the radial extent of the handle being not constant along said arc of a circumference and the handle comprising a zone having a first radial extent, and a zone adjacent thereto having a second radial extent smaller than the first radial extent, so that when the handle is gripped by a user, the zone having the first radial extent is gripped by the index finger and the medium finger, and the zone having the second radial extent is gripped by the ring finger and the little finger.

Preferably the grip-only handle comprises a body portion having a first edge that is an arc of circumference and adjoins when the grip-only handle is assembled to the frame assembly, the at least one frame and a free edge that: contacts the first edge at a first end of the handle, is then curved, having a radially inner convexity so that the radial extent of the handle increases to a maximum and then decreases again to a minimum greater than zero at a corner near a second end of the handle, and after the corner is straight along an almost radial direction, until it contacts the first edge at the second end of the handle.

Preferably the grip-only handle protrudes radially inwards from the at least one frame.

Preferably the grip-only handle does not protrude outwards of said at least one frame.

Preferably the hinge is located on a left side of said porthole, as seen from the outside of said laundry machine.

In an advantageous embodiment the grip-only handle is arranged in such a way to be individually separable from said frame assembly. "Individually" means that the grip-only handle can be separated as a single-body from the rest of the frame assembly, i.e. a separation of other parts of the frame assembly is not required (with the possible exception of screws or other fixing devices) in order to separate the grip-only handle from the frame assembly. In this way, if user needs changing the position of the handle since, for example, the handle belongs to the porthole of a drier which has to be moved over a washing machine, it is not necessary to completely dismantle the frame assembly (for example separating the inner from outer frame), but it is sufficient to separate the handle from the frame assembly, and moving it to the suitable prefixed position.

In an advantageous embodiment the frame assembly comprises an outer frame, an inner frame, and a glass supported by the outer frame and the inner frame, and the grip-only handle is preferably arranged in such a way to be individually separable from the outer frame and inner frame for allowing to change its position among said at least two prefixed positions. In other words in this advantageous embodiment the grip-only handle can be separated from and attached to the inner and outer frame as a single body, which is a much easier operation than, for example rotating a whole outer frame (in case for example the handle is a single body with the latter) with respect to an inner frame.

The Applicant also found that the above object is achieved by providing a grip-only handle that is reinforced against flexural stress.

In an aspect, the invention relates to a laundry machine comprising a cabinet housing a chamber for treating laundry having a rotation axis, a porthole for providing access to and tightly closing the chamber, a hinge to pivot the porthole to the cabinet, an electromechanical lock comprising a first member on the porthole and a matching member on the cabinet, and a grip-only handle, wherein said electromechanical lock is configured to be released by applying a force beyond a threshold onto the porthole away from the cabinet, wherein said porthole comprises at least one frame and a glass secured to the at least one frame, and wherein said grip-only handle comprises a body portion that protrudes radially inwardly from the at least one frame and extends along an arc of a circumference, there being a wall of the handle or of the at least one frame crossing the body portion at an intermediate zone of the body portion, and a plurality of reinforcing ribs extending from the body portion and the wall.

Preferably the ribs are generally L-shaped bodies arranged at a corner between the wall and the body portion, on the inner side of the grip-only handle facing, when the porthole is closed, the chamber.

Preferably, each rib includes a long edge adjoining an inner side of the body portion from the wall towards a free edge of the body portion, and a short edge adjoining at least part of the wall.

Preferably, the ribs extend parallel to each other. Alternatively, each rib extends in a radial plane.

Further features of the laundry machine of this aspect are detailed above with respect to the first aspect of the invention.

The Applicant also found that the above object is achieved by providing an ergonomic grip-only handle.

In an aspect, the invention relates to a laundry machine comprising a cabinet housing a chamber for treating laundry having a rotation axis, a porthole for providing access to and tightly closing the chamber, a hinge to pivot the porthole to the cabinet, an electromechanical lock comprising a first member on the porthole and a matching member on the cabinet, and a grip-only handle, wherein said electromechanical lock is configured to be released by applying a force beyond a threshold onto the porthole away from the cabinet, wherein said porthole comprises at least one frame and a glass secured to the at least one frame, wherein said grip-only handle protrudes radially inwardly from the at least one frame and extends along an arc of a circumference, the radial extent of the handle being not constant along said arc of a circumference and the handle comprising a zone having a first radial extent, and a zone adjacent thereto having a second radial extent smaller than the first radial extent, so that the when the handle is gripped by a user, the zone having the first radial extent is gripped by the index finger and the medium finger, and the zone having the second radial extent is gripped by the ring finger and the little finger.

Preferably the grip-only handle comprises a body portion having a first edge that is an arc of circumference and adjoins the at least one frame and a free edge that: contacts the first edge at a first end of the handle, is then curved, having a radially inner convexity so that the radial extent of the handle increases to a maximum and then decreases again to a minimum greater than zero at a corner near a second end of the handle, and after the corner is straight along an almost radial direction, until it contacts the first edge at the second end of the handle.

Further features of the laundry machine of this aspect are detailed above with respect to the first aspect of the invention.

BRIEF DESCRIPTION OF THE DRAWINGS

Features and advantages of the present invention will be more readily understood from the following detailed description of some advantageous embodiments thereof, which is provided below by way of non-limiting example with reference to the accompanying drawings, wherein.

DETAILED DESCRIPTION OF EXAMPLE EMBODIMENTS

Like elements are denoted by like reference signs throughout the figures.

Figure 1:
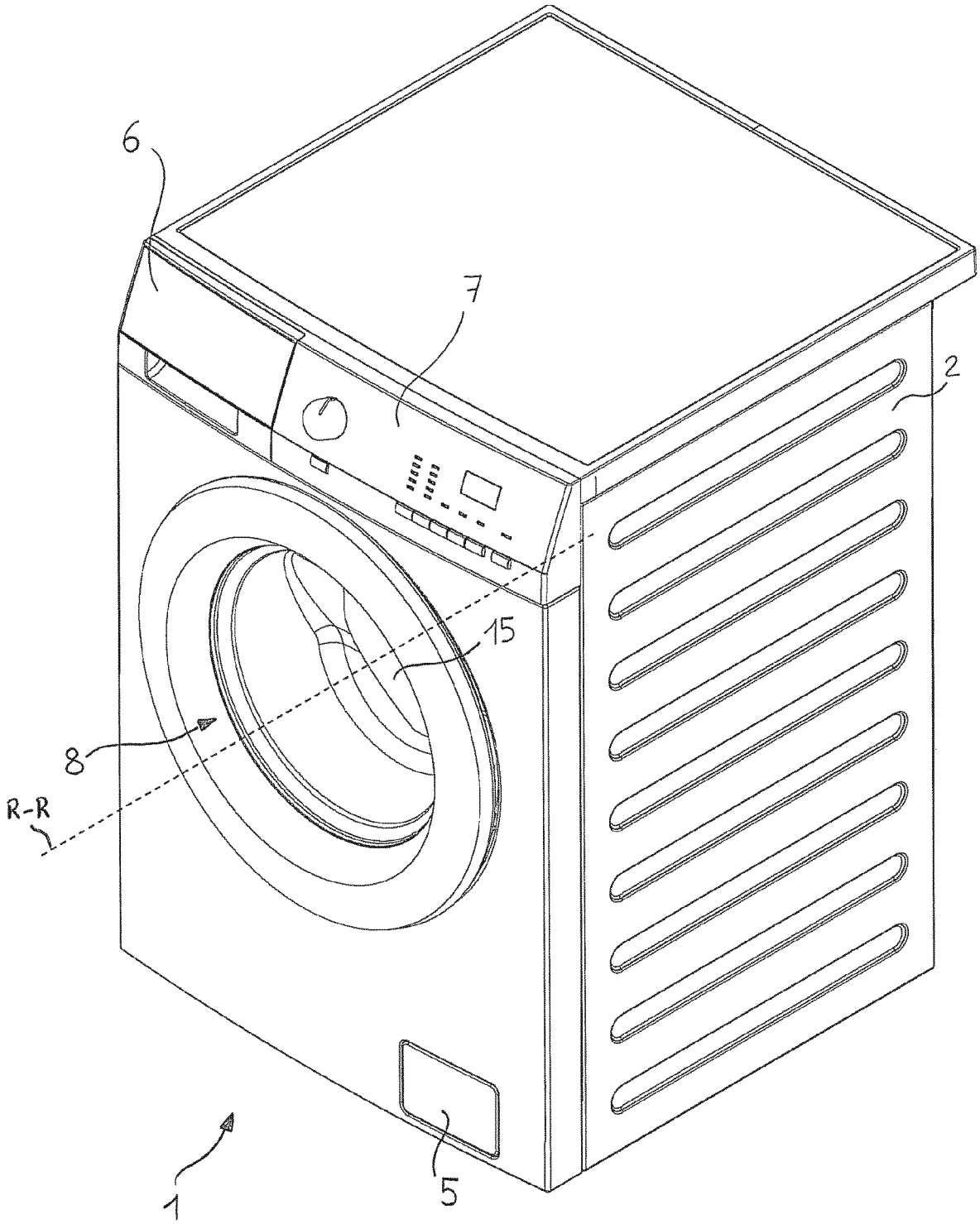
FIG. 1 shows a perspective view of a laundry machine according to an aspect of the invention, wherein a porthole of the laundry machine is closed.
Figure 2:
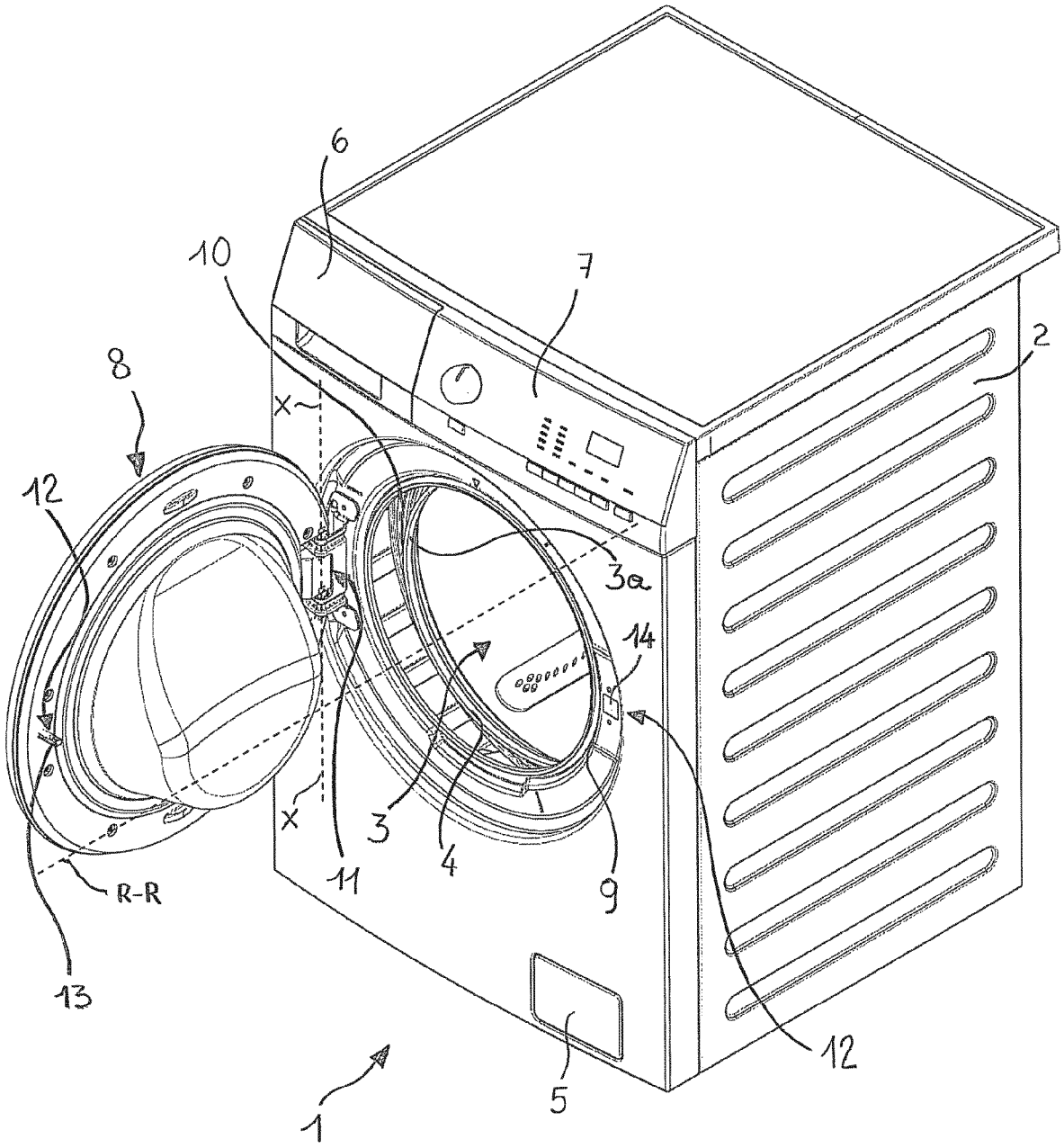
FIG. 2 shows a perspective view of the laundry machine of FIG. 1, wherein the porthole is open.
Figure 3:
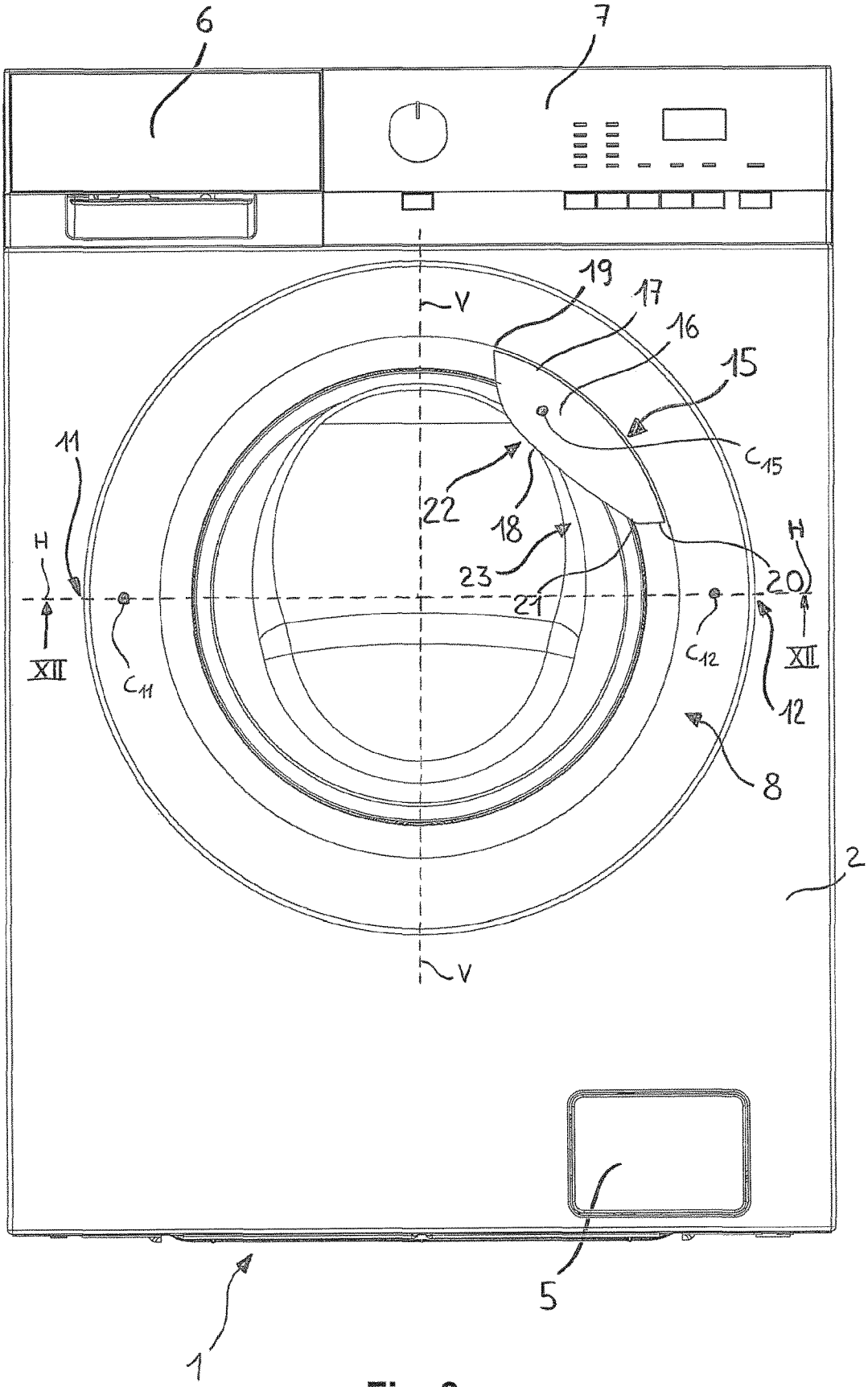
FIG. 3 shows a front view of the laundry machine of FIG. 1, wherein the porthole is closed.

In FIGS. 1, 2, and 3 a laundry machine 1 is shown in perspective and front views. In the case shown, the laundry machine 1 is a washing machine, but the laundry machine of aspects of the invention can be a washing-drying machine or a dryer.

The laundry machine 1 comprises a parallelepiped cabinet (or housing) 2. The cabinet 2 may be advantageously made of a frame covered by a metal sheet, e.g. a steel sheet.

Cabinet 2 houses a chamber 3 for treating laundry. The chamber 3, in the case shown of a washing machine, is a drum 4 rotatably mounted within a tub (not visible) about a rotation axis RR. In the advantageous example shown in the attached figures, rotation axis RR is, when the machine is installed on the floor, in an operative position, like in the example shown in FIGS. 1 and 2, substantially horizontal, but in a different advantageous embodiment this axis RR can be inclined.

As shown, the cabinet 2 of the laundry machine 1 may advantageously include a lid 5 for accessing a filter (not shown), a drawer 6 for a detergent, softening agent and/or other additives, as well as a control panel 7. These components may be missing and/or other components may be present on the cabinet 2.

A porthole 8 for providing access to and tightly closing the chamber 3 is provided at the front wall of the cabinet 2, specifically at an opening 9 of the cabinet 2 and at an opening 3*a* of the chamber 3.

A gasket (or bellows) 10 is provided at the opening 9 of the cabinet 2 and connects the border of this opening 9 to the inlet opening of the washing tub (not illustrated).

A hinge 11 is provided to pivot the porthole 8 to the cabinet 2 so that it can be opened by rotating it about a vertical axis XX, as shown in FIG. 2. The hinge 11 is arranged in such a way that, when the porthole 8 is closed, its center of mass C11 (see e.g. FIG. 3) is located, with respect to the rotation axis RR, at a first angular position.

Preferably, hinge 11 is arranged across, and more preferably centered across, a horizontal median plane HH of the porthole 8.

Figure 12:
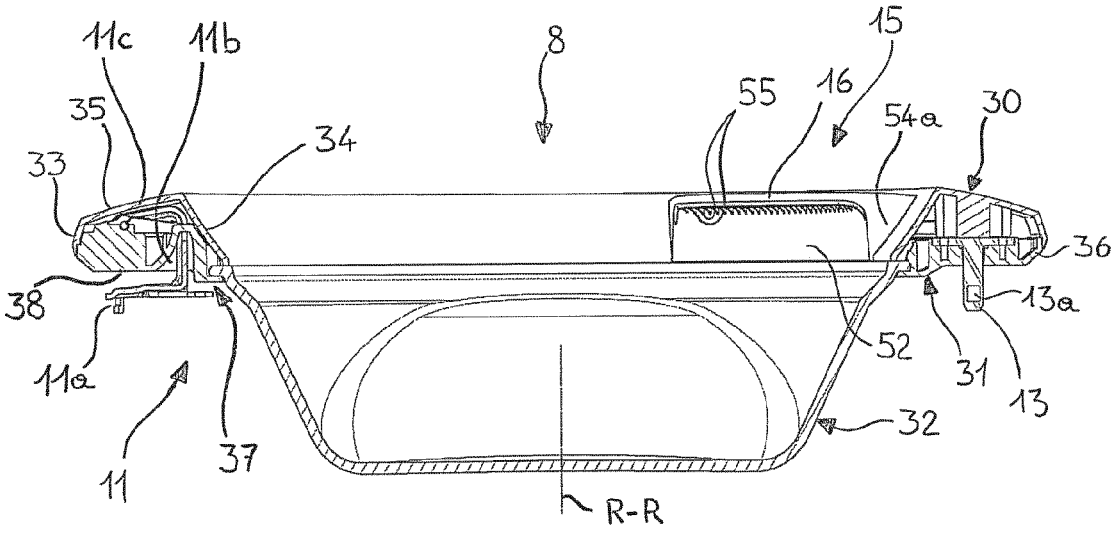
FIG. 12 shows a sectional view of the porthole of FIGS. 9, 10 and of its hinge, taken along line XII-XII of FIG. 3.

Hinge 11 may be any conventional hinge, preferably of the type that is not visible when the porthole 8 is closed. In the embodiment shown in the figures, hinge 11 comprises a portion 11*a* (FIGS. 9, 10, 12) fixed to the cabinet 2, a seat 11*b* (FIGS. 9, 10, 12) for housing it provided in the porthole 8, and a hinge pin (not shown) extending in holes of the portion 11*a* and of the seat 11*b*, wherein holes 11*c* of the seat 11*b* are visible in FIGS. 9 and 12.

An electromechanical lock 12 is provided between the porthole 8 and the cabinet 2. The lock 12 comprises a portion or first member fixed to the cabinet 2 and a portion or second, matching member fixed to the porthole 8 that cooperate with each other.

The lock 12 is configured to avoid opening of the porthole during operation of the machine; and to possibly to avoid operation of the machine with the porthole open, by issuing a consent signal to an electronic control unit of the machine only when the porthole is closed and/or delay opening of the porthole after the end of an operation cycle. The electromechanical lock is therefore also an interlock.

Advantageously the first member comprises a latch 13 protruding from the porthole 8 towards the cabinet 2—visible in FIGS. 2, 9, 10 and 12—and the second member comprises a latch retaining mechanism 14 for receiving the latch 13, positioned at the cabinet 2.

The latch 13 is shown as a protrusion having an aperture 13*a*. The entire latch retaining mechanism 14 is not visible in the figures, only a seat for receiving the latch 13 is visible. The latch retaining mechanism 14 preferably includes, in a manner known per se, a mobile part which is configured to be movable between a retaining position, in which it engages the latch 13 so as to retain the porthole 8 in a closed condition, and an opening position it which it releases the latch 13 so as to allow the opening of the porthole 8. The mobile part of the latch retaining mechanism 14 at the cabinet 2 preferably interacts with an elastic element, for example a spring, which allows the releasing of the latch 13 when a releasing force is applied which is greater than a threshold force. The porthole 8 is therefore of the "pull-to-open type", opened by applying a force beyond a threshold onto the porthole 8 away from the cabinet 2.

The lock 12 is preferably arranged across, and more preferably centered across, the horizontal median plane HH of the porthole 8.

The first member 13 of lock 12 is arranged in such a way that, when the porthole 8 is closed, its center of mass C12 (see e.g. FIG. 3) is located, with respect to the rotation axis RR, at a different angular position than the center of mass C11 of the hinge 11, preferably at a diametrically opposite angular position with respect to hinge 11.

A grip-only handle 15 is provided at the porthole 8, to be gripped by a user for applying a pulling force onto the porthole 8 away from the cabinet 2.

The porthole 8 is usually opened by pulling it outwards with enough force through the handle 15, but it can also be opened by pushing it from the inside of the drum 4, e.g. by a caught child thanks to its "pull-to-open type" construction.

A grip-only handle 15 in connection with a "pull-to-open" porthole or lock has several advantages. It is easier and less expensive to manufacture than a pivotal handle operating a movable hook at the porthole, especially when it is one piece with a frame of the porthole 8 as discussed below. Moreover it is more robust than a pivotal handle.

The grip-only handle 15 protrudes radially inwardly from the frame of the porthole 8, specifically from the inner circumferential edge of an outer frame 30 thereof (see below).

The grip-only handle 15 is provided at a position which is not aligned or not corresponding with the position of the lock 12. The grip-only handle 15 is arranged such that, when the porthole 8 is closed, its center of mass C15 is located, with respect to the rotation axis RR, at a different angular position than the center of mass C12 of the first member 13 of the lock 12.

The grip-only handle 15 is preferably located or arranged outside the horizontal median plane HH of the porthole 8. The grip-only handle 15 is thus offset with respect to horizontal median plane HH and the lock 12. In case of a large extent of the handle 15 and/or of the lock 12, the two might however overlap in part.

In the case shown, wherein the porthole 8 is circular and it is hinged at its left (as viewed from the front of the laundry machine 1 when the porthole is closed), the hinge 11 is advantageously centered across a position at 9 o'clock or 180° in a conventional angular reference system, and the lock 12 is across a position at 3 o'clock or 0°. Thus the centers of mass C11 and C12 of hinge 11 and first member 13 of lock 12 lie on the median plane HH when they are symmetric.

In FIGS. 1 to 3, the grip-only handle 15 is shown arranged in the first quadrant, i.e. between 0° and 90°. A vertical centerline VV of the porthole 8 is also indicated in FIG. 3 to easily identify the quadrants. Advantageously the grip-only handle 15 extends for an arc or circumference lying in the generally central portion of the first quadrant.

Figure 4:
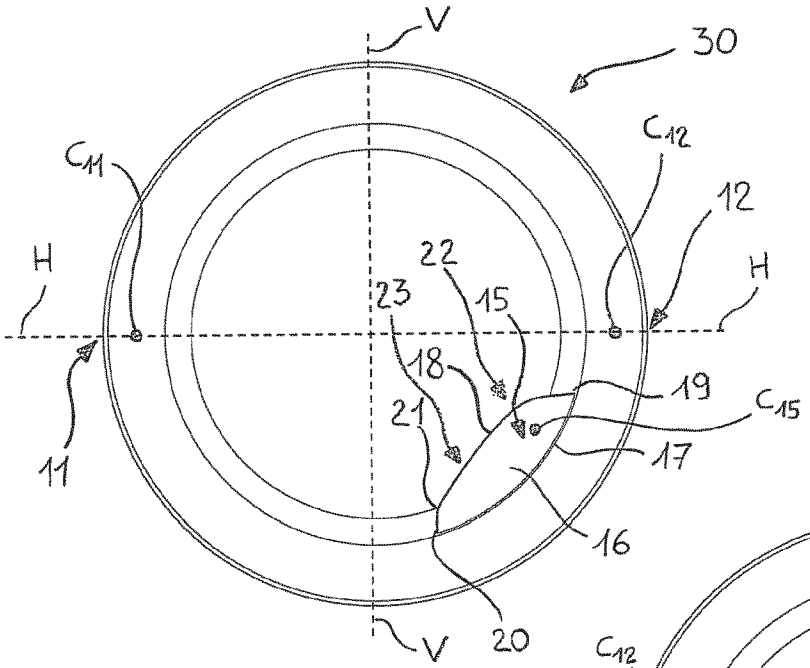

In case the laundry machine 1 is to be arranged on top of another equipment or piece of furniture, like in the case of a dryer machine arranged on top of a washing machine, the grip-only handle 15 may be arranged in the fourth quadrant, i.e. between 270° and 360°, as shown in FIG. 4.

Figure 5:
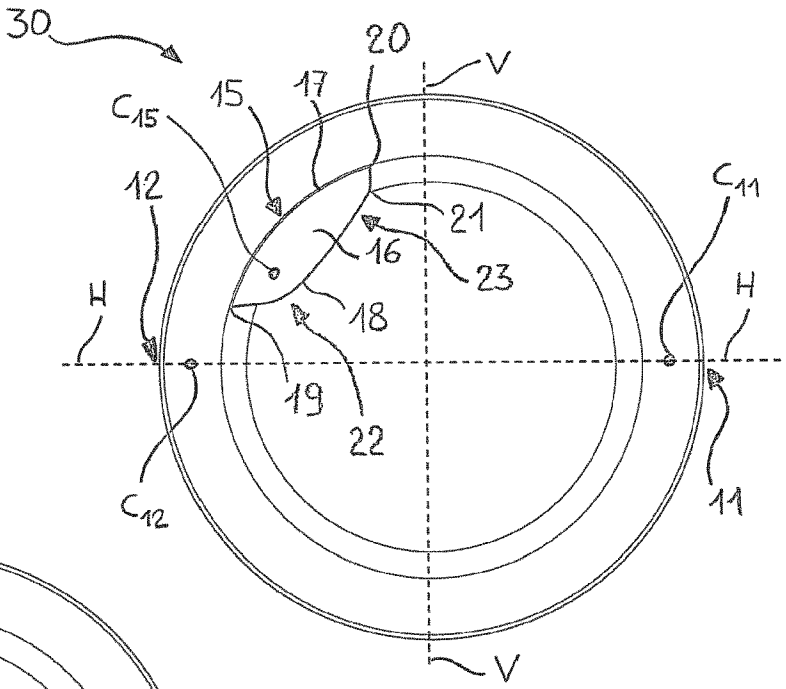
FIGS. 4-8 diagrammatically show different shapes and positions of a handle of the laundry machine according to an aspect of the invention.

In case the laundry machine 1 is hinged at its right, and arranged on the floor, then the grip-only handle 15 may be arranged in the second quadrant, i.e. between 90° and 180° as shown in FIG. 5.

Figure 6:
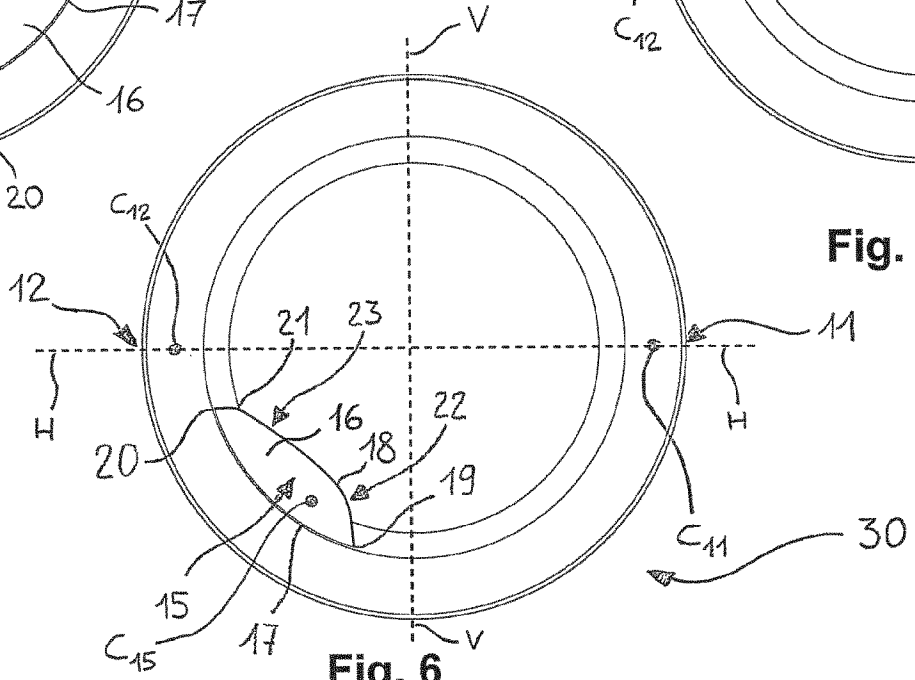

Finally, in case the laundry machine 1 is hinged at its right, and arranged on top of another equipment or piece of furniture, as shown in FIG. 6, then the grip-only handle 15 may be arranged in the third quadrant, i.e. between 180° and 270°.

It is immediately recognized that in all four cases, even if the position of the centers of mass C11, C12, C15 is just estimated in the drawings, the grip-only handle 15 and the first member 13 of electromechanical lock 12 are arranged in such a way that, when the porthole 8 is closed, their centers of mass C15 and C12 are located, with respect to the rotation axis RR, at different angular positions.

Moreover, in all four cases, the hinge 11 is arranged in such a way that, when the porthole 8 is closed, its center of mass C11 is located, with respect to the rotation axis RR, at a diametrically opposite angular position with respect to the center of mass C12 of the first member 13 of the electromechanical lock 12.

Moreover, in all four cases the grip-only handle 15 and the first member 13 of the lock 12 are arranged such that, when the porthole is closed, their centers of mass C15, C12 are located, with respect to the rotation axis, at angular positions that are reciprocally spaced by less than 90°.

Thus, the grip-only handle 15 is preferably arranged in the half of the porthole about the electromechanical lock 12.

In FIGS. 4-6 only an outer frame 30 of the porthole 8 is shown. A glass 32 of the porthole 8 is not shown. The construction of the porthole 8 is better disclosed below with reference to FIGS. 9, 10. Moreover, in those figures the position of the hinge 11 and of the lock 12 is indicated with the same reference numbers, even if the two are not visible.

In FIG. 3-6 an identical handle 15 is shown in all four prefixed positions with respect to the frame 30. The handle 15 can be one piece with the frame 30 or positionable with respect to it. Before discussing how this can be achieved, it is noted that a handle 15*a* having a shape that is for example the mirror image of that of handle 15 may be provided in the case of porthole 8 hinged at its right, as shown in FIG. 7 and in FIG. 8.

Figure 8:
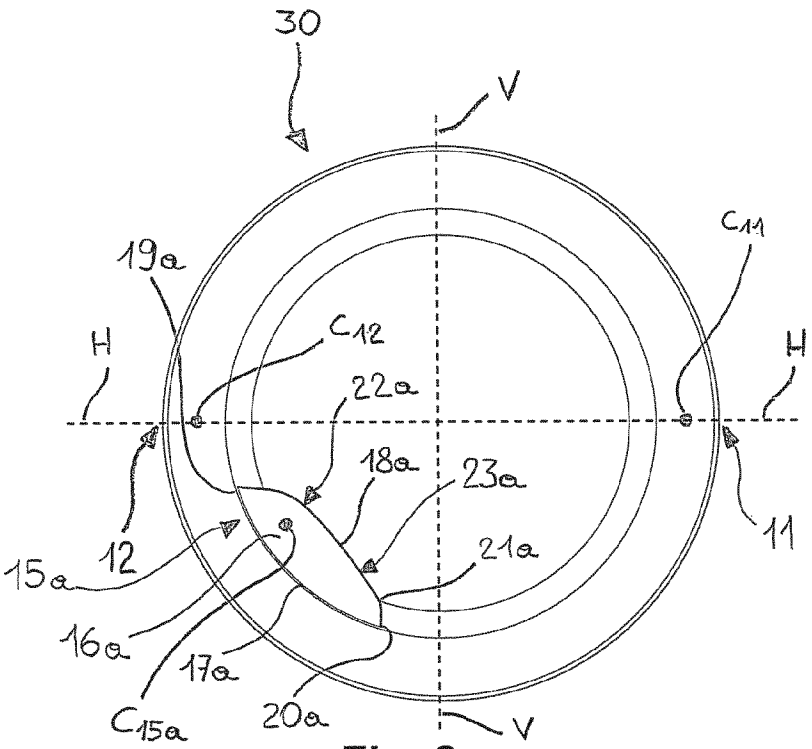
Figure 7:
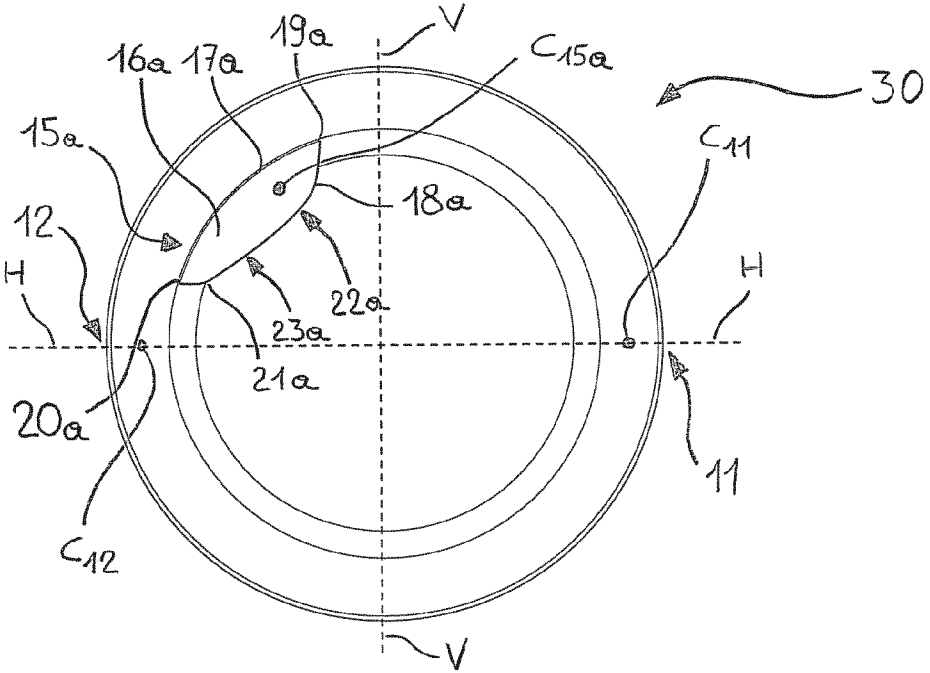

By the possibility of assembling a plurality of differently-shaped handles to a same porthole 8, the handle may always be configured with an ergonomic shape, as shown by the handle 15 in FIGS. 3, 4 and the handle 15*a* in FIGS. 7, 8.

Such handle 15, 15*a* as shown in FIGS. 3, 4, 7, 8 has a body part 16, 16*a* cantilever or protruding radially inwardly from the outer frame 30 of the porthole 8, and extending along an arc of a circumference, e.g. of about 40-55°. The body part 16 is preferably generally flat, as defined above. Preferably, the body part 16, 16*a* has a first edge 17, 17*a* that is an arc of circumference and adjoins the inner circumference of a slanted wall 35 (see below) of the outer frame 30 of the porthole 8. Preferably, the body part 16, 16*a* has a second or free edge 18, 18*a* cantilevered from the outer frame 30 of the porthole 8. Preferably the body part 16, 16*a* has a radial extent defined between the first edge 17, 17*a* and the free edge 18, 18*a*.

The radial extent of the handle 15, 15*a* is preferably not constant. The free edge 18, 18*a* preferably adjoins or contacts the first edge 17, 17*a* at a first end 19, 19*a* of the handle 15, 15*a* that is upper in the mounted condition of the handle 15, 15*a* shown in FIGS. 3, 4, 7, 8, so that the radial extent of the handle 15, 15*a* at first end 19, 19*a* is zero. Moving towards a second end 20, 20*a* of the handle 15, 15*a*, opposite the first end 19, 19*a* and lower in the mounted condition of the handle 15, 15*a* shown in FIGS. 3, 4, 7, 8, the free edge 18, 18*a* is preferably first curved, having a radially inner convexity so that the radial extent of the handle 15, 15*a* increases to a maximum and then decreases again to a minimum greater than zero at a corner 21, 21*a* near the second end 20, 20*a* of the handle 15, 15*a*; after the corner 21, 21*a* the free edge 18, 18*a* is straight along an almost radial direction, until it adjoins or contacts the first edge 17, 17*a* at the second end 20, 20*a* of the handle 15, 15*a*.

The handle 15, 15*a* thus preferably comprises a zone 22, 22*a* having a first or comparatively large radial extent, and a zone 23, 23*a* adjacent thereto having a second or comparatively small radial extent, smaller than the first radial extent, so that when the handle 15, 15*a* is gripped by a user, the zone 22, 22*a* having the first or comparatively large radial extent is gripped by the index finger and the medium finger, and the zone 23, 23*a* having the second or comparatively small radial extent is gripped by the ring finger and the little finger.

The handle 15, 15*a* is therefore ergonomic when in the positions of FIGS. 3, 4, 7, 8, what helps the user to easily apply the required force to pull open the porthole 8.

It is noted that usually dryer machines have a reversible porthole (left/right hinge), while washing and washing-dryer machines do not. This is because of the need of electrical connections in the latter type of machines to provide for safety closure of the chamber during operation of the machine.

As discussed in the introductory part of the disclosure, the described arrangement of electromechanical lock 12 and handle 15 provides several advantages.

An advantageous embodiment of the porthole 8 is now better disclosed with reference to FIGS. 9-12.

The porthole 8 preferably comprises an outer frame 30, an inner frame 31 and a glass 32 sandwiched between the outer frame and the inner frame.

Figure 9:
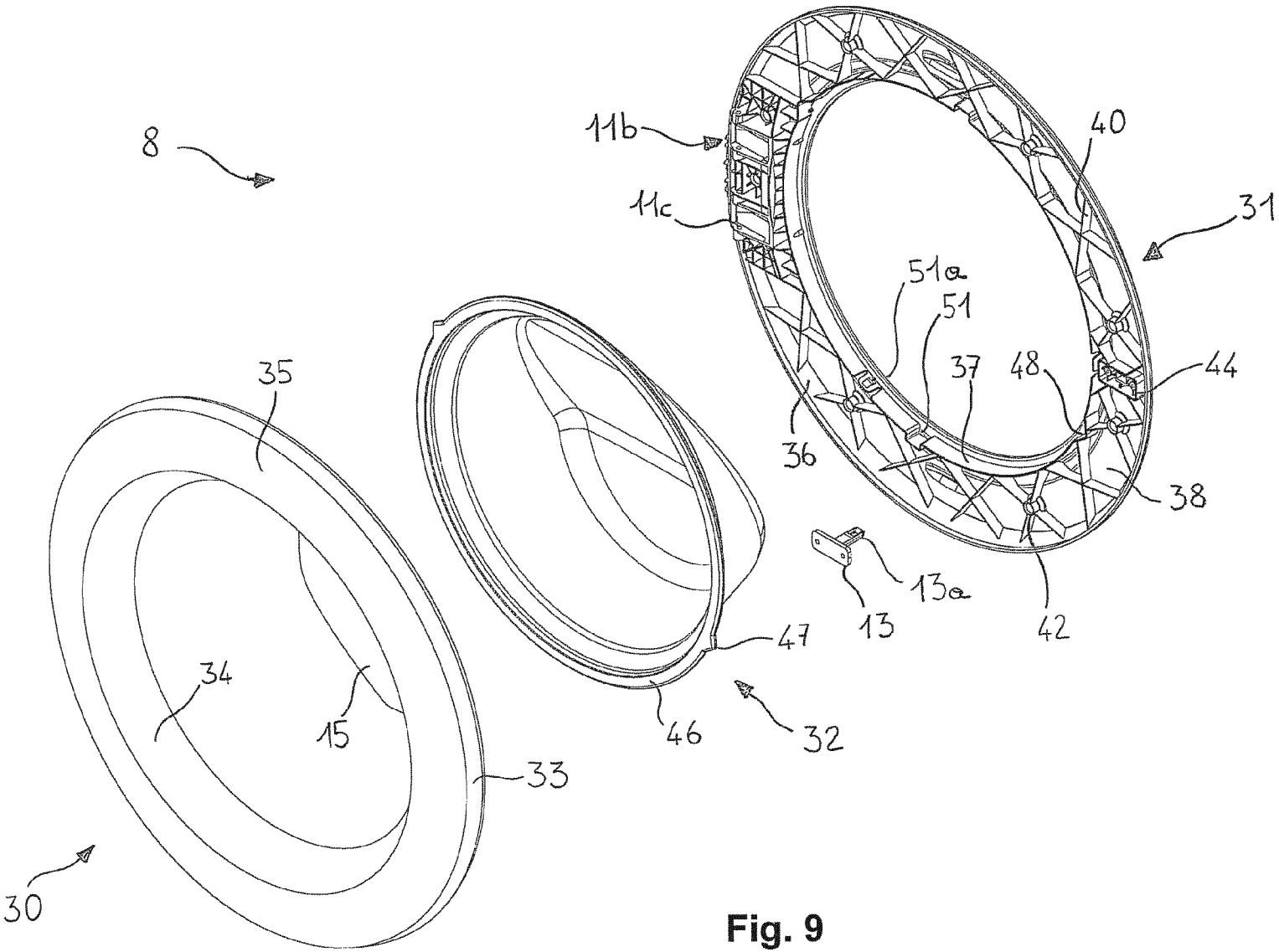
FIGS. 9 and 10 show two perspective exploded views of the porthole of the laundry machine of FIG. 1, respectively from the outside and from the inside thereof.
Figure 10:
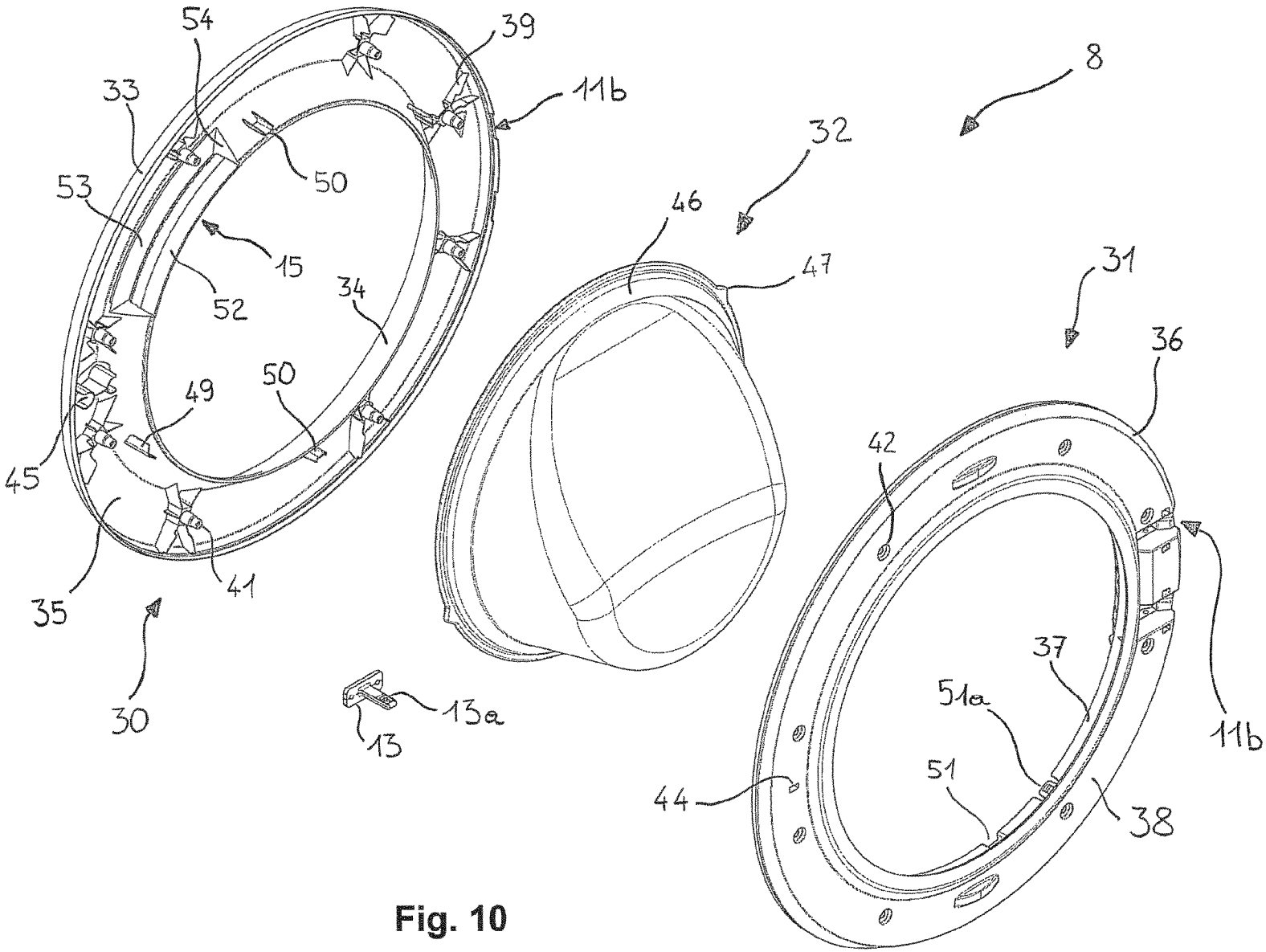

The latch 13 is also shown in an exploded condition in FIGS. 9, 10.

The outer frame 30 is a preferably generally annular member, having an outer circumferential edge 33 and a preferably beveled inner circumferential edge 34. Between the outer circumferential edge 33 and the inner circumferential edge 34, the outer frame 30 has a preferably slanted wall 35. The slanted wall 35 is preferably closer to the cabinet 2 at the outer circumferential edge 33 than at the inner circumferential edge 34, with reference to the closed condition of the porthole 8 (see FIG. 12).

The inner frame 31 is also a preferably generally annular member, having a preferably tapered outer circumferential edge 36 and an inner circumferential edge 37. Preferably, between the outer circumferential edge 36 and the inner circumferential edge 37, the inner frame 31 has a flat wall 38.

On the side coupling with each other, i.e. looking from the outside of the laundry machine 1 the inner side of outer frame 30 and the outer side of inner frame 31, the outer frame 30 and the inner frame 31 are preferably generally concave and advantageously they have a plurality of reinforcing ribs 39, 40, respectively. The outer frame 30 and the inner frame 31 have preferably also matching system for coupling to each other, with the interposition of the glass 32 and the latch 13. In the embodiment shown, the outer frame 30 has advantageously a plurality of internally threaded bushings 41 and the inner frame 31 advantageously has a plurality of holes 42 in corresponding prefixed positions, for receiving a plurality of screws or bolts (not shown). The ribs 39, 40 preferably extend about the bushings 41 and about the holes 42, respectively.

Any other matching system may be suitable, such as snap pins, welding, gluing and similar.

The seat 11*b* for the hinge 11 is advantageously made in the inner frame 31 and partly in the outer frame 30. Advantageously, in the inner frame 31, preferably diametrically opposite the centerline of the seat 11*b* for the hinge 11, there is an apertured seat 44 for the passage of the latch 13.

Advantageously the inner side of the outer frame 30 has a protruding spacer 45 for abutting the latch 13 and keeping it out of the apertured seat 44 in inner frame 31.

The glass 32 is preferably generally convex towards the inside of the laundry machine 1, protruding inwards from the inner frame 31. The shape of the glass 32 can depart from that shown.

The glass 32 has preferably a circumferential rim 46 that is sandwiched between the outer frame 30 and the inner frame 31.

Preferably, circumferential rim 46 has two diametrically opposite triangular protrusions 47. Advantageously, the inner frame 31 has, on its inner circumferential edge 37, notches 48 for housing the triangular protrusions 47 of the glass 32. Advantageously, the outer frame 30 has, on its inner side, triangular protrusions 49 defining seats for the triangular protrusions 47 of the glass 32. Thus, the rotational position of the glass 32 is well defined.

Advantageously, further matching lugs 50 and recesses 51 are provided on the inner and outer frames 30, 31, respectively, to define the rotational mutual position thereof.

Advantageously, the inner frame 31 has, on its inner circumferential edge 37, elastic retainers 51*a* defining the axial position of glass 32.

The handle 15 is preferably one piece with the outer frame 30 and radially protrudes inward, cantilever from the inner circumferential edge 34. It is noted that in FIG. 10 the protruding portion of the handle 15 is hidden by the outer frame 30.

Figure 13:
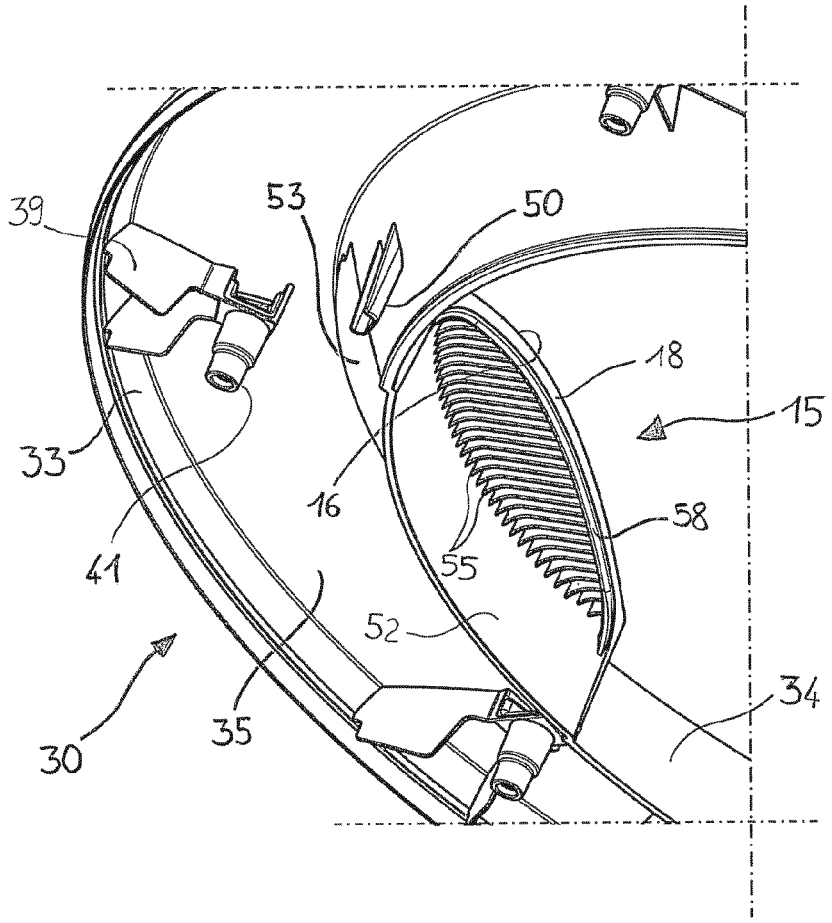
FIGS. 13 and 13*a* show an enlarged detail of the handle of the porthole of FIGS. 9, 10, in perspective from the inner side thereof and in a cross section taken along line XIII-XIII of FIG. 11, respectively.
Figure 13A:
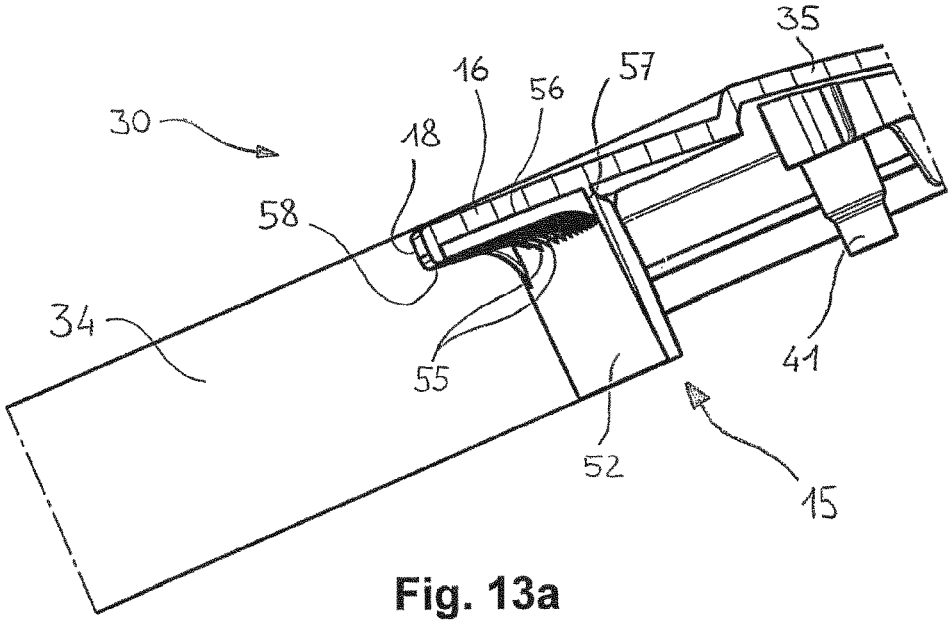

As visible in FIG. 13*a*, the body part 16 of handle 15 is, advantageously, slightly recessed with respect to the slanted wall 35 of the outer frame 30 near its circumferential inner edge, and ends, at its free edge 18, flush with the slanted wall 35 of the outer frame 30 so as not to protrude from the outer frame 30 outwards, i.e. away from the cabinet 2 in the closed condition of the porthole 8.

As visible in FIGS. 10-13 and 13A, the beveled inner circumferential edge 34 of the outer frame 30 is, advantageously, interrupted at the handle 15 by a wall 52 extending along part of a cylindrical surface flush with the radially inner edge of the beveled inner circumferential edge 34. Radially outer part 53 of the body portion 16 and lateral walls 54 advantageously fill the gap between the wall 52 and the beveled inner circumferential edge 34. Between the body portion 16 of the handle 15 and the inner circumferential edge 34 of the outer frame 30 there are also lateral walls 54*a*.

The body portion 16 of the handle 15 is thus crossed by the wall 52 at an intermediate zone of the body portion 16. This enhances the strength of the handle 15.

A plurality of reinforcing ribs 55 advantageously extend from the body portion 16. Advantageously, the ribs 55 are generally L-shaped bodies arranged at the corner between the wall 52 and the body portion 16, on the radially inner side of handle 15 facing, when the porthole 8 is closed, the chamber 3 and/or the cabinet 2.

Reinforcing ribs 55 are preferably generally flat.

Each rib 55 includes a long edge 56 adjoining the inner side of the body portion 16 from the wall 52 towards and preferably up to the free edge 18, and a short edge 57 adjoining at least part of the wall 52.

The reinforcing ribs 55 may also extend shorter along the body portion 16 and/or longer along wall 52 (even up to its free edge) than shown.

When molding the outer frame 30 with the handle 15 and its reinforcing ribs 55 in plastics, the material flowing in the ribs 55 would tend to make depressions on the opposite side (outer side) of the flat body 16 of the handle 15. In order to avoid these depressions to be seen from the front of the laundry machine 1, the ribs 55 should be made enough thin. On the other hand, the ribs 55 should be made enough thick and/or close to each other as to provide enough reinforcement against the flexural stress during opening of the porthole 8. A skilled in the art will find a proper compromise between the two opposite requirements without the exercise of inventive skills.

Preferably, but not necessarily, the reinforcing ribs 55 may have a thickness, e.g. of 1.2 mm, that is at most 40% of the thickness of the body portion 15, the latter being e.g. of 3 mm; the distance between reinforcing ribs 55 may be shorter than or equal to 2.8 mm. With those figures, there are about 25 reinforcing ribs 55 in 100 mm of length of the body portion 16.

The ribs 55 may extend parallel to each other as shown, or each rib 55 can extend in a radial plane.

The reinforcing ribs 55 also improve the grip on the handle 15 because they avoid slipping of the hand, especially a wet hand as may well occur when dealing with washing laundry.

The handle 15, 15*a* can be made one piece with the outer frame 30—or generally speaking with the porthole 8—as shown thus far. To have the handle 15, 15*a* mounted in the various prefixed positions disclosed in connection with FIGS. 3-8, however, two different outer frames 30 for a same handle 15 as shown in FIGS. 3-6 have to be manufactured, four different outer frames 30 for an always ergonomic handle 15, 15*a* as shown in FIGS. 3, 4, 7, 8. However, a handle 15, 15*a* made one piece with the outer frame 30, such as co-molded therewith, is very strong, inexpensive and neat.

Figure 11:
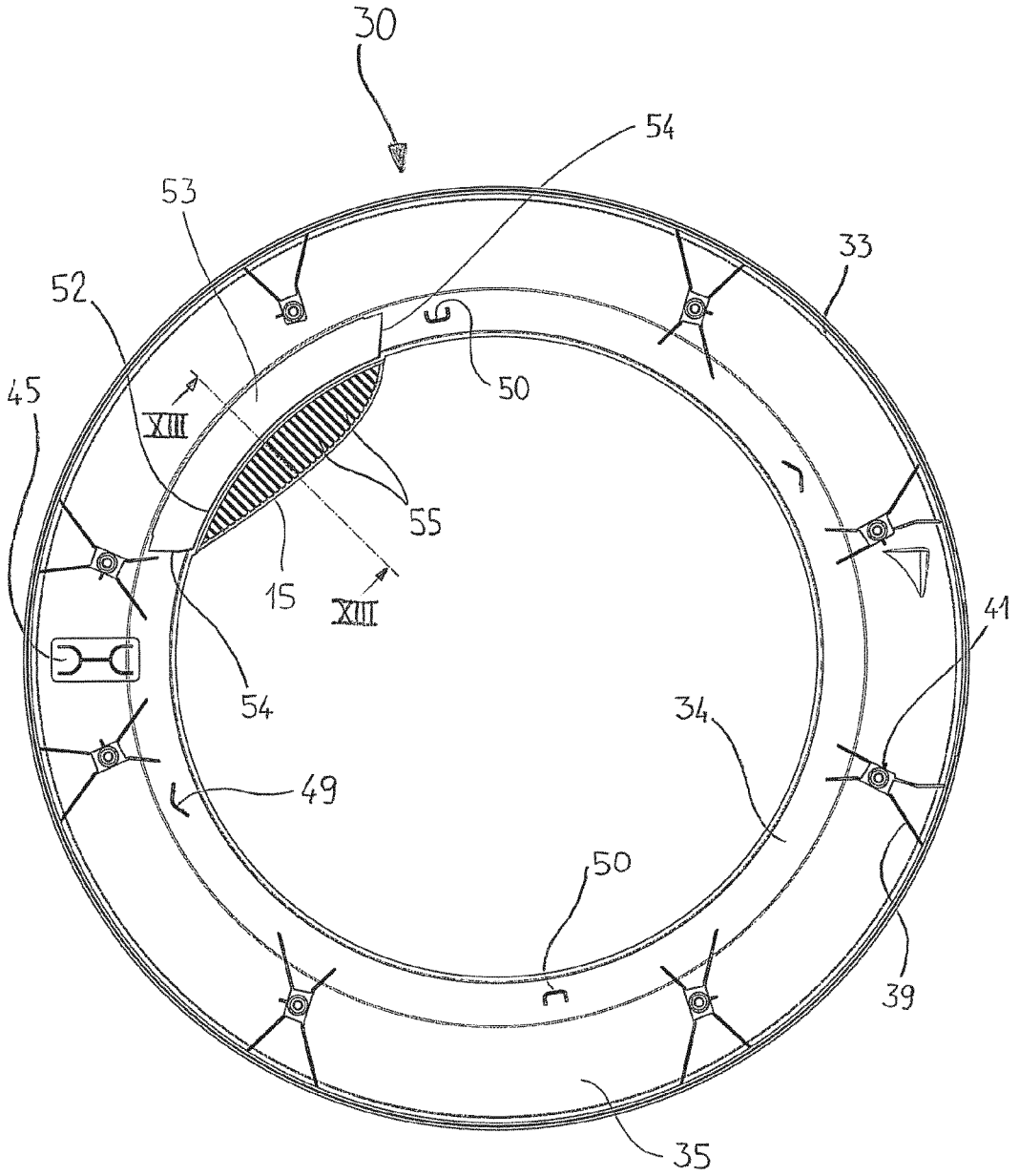
FIG. 11 shows a rear view of an outer frame of the porthole of FIGS. 9, 10, with one piece handle.
Figure 14:
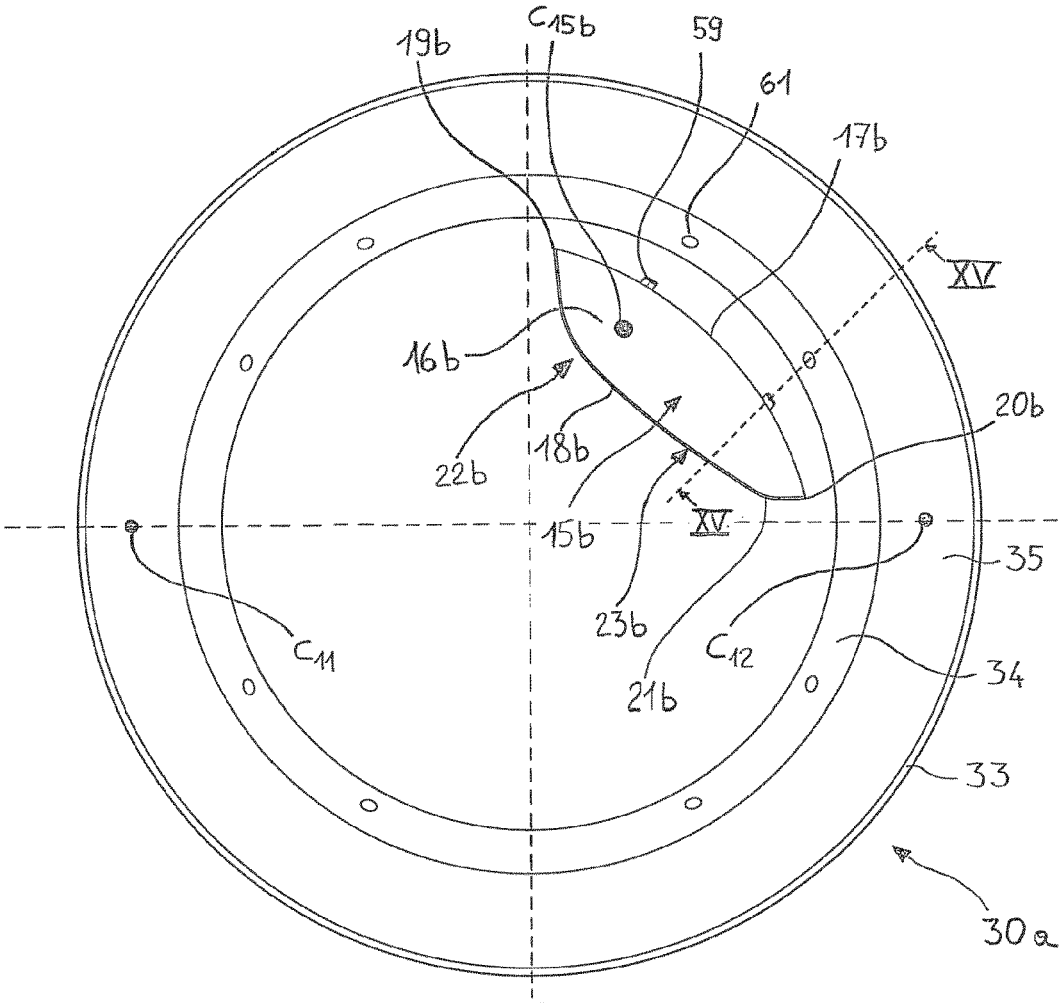
FIG. 14 shows a front view of an outer frame of a porthole and handle according to another embodiment of the invention, having a removable handle.
Figure 15:
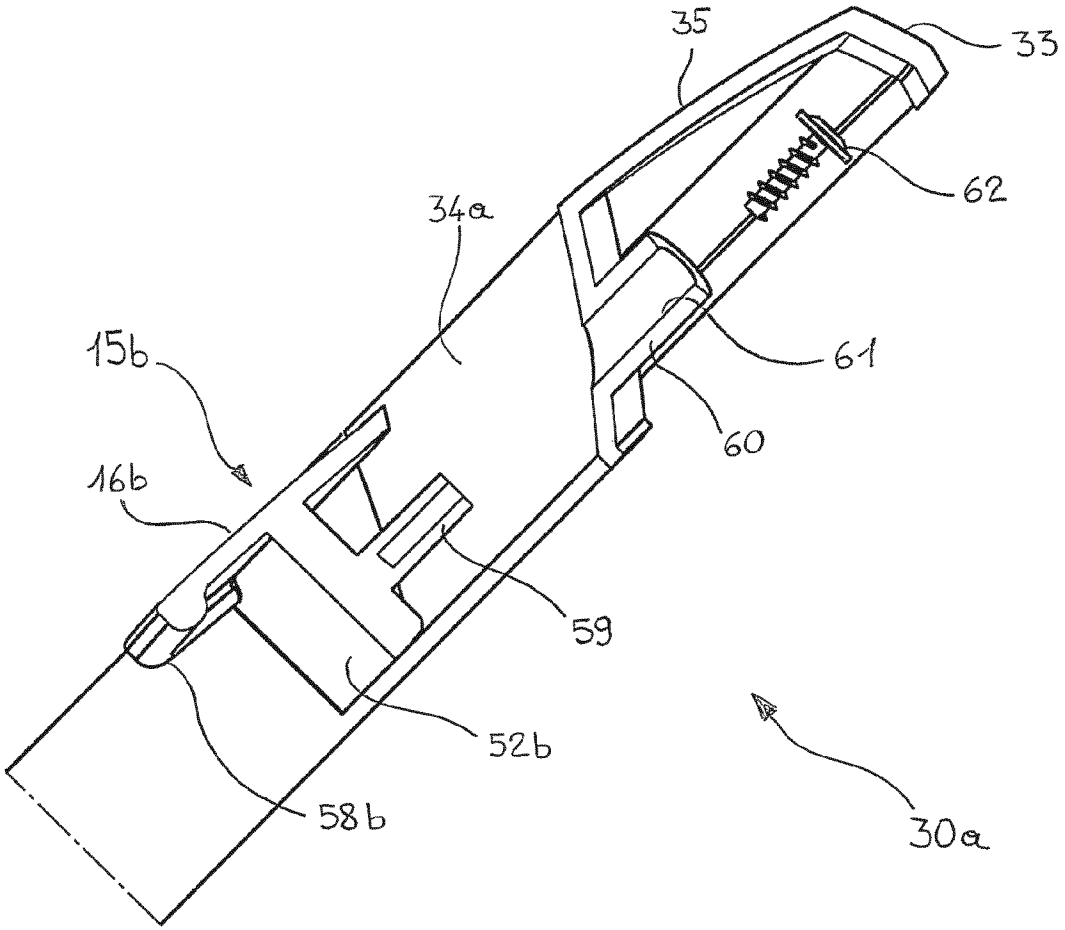
FIG. 15 shows a sectional view taken along line XV-XV of FIG. 14.
Figure 16:
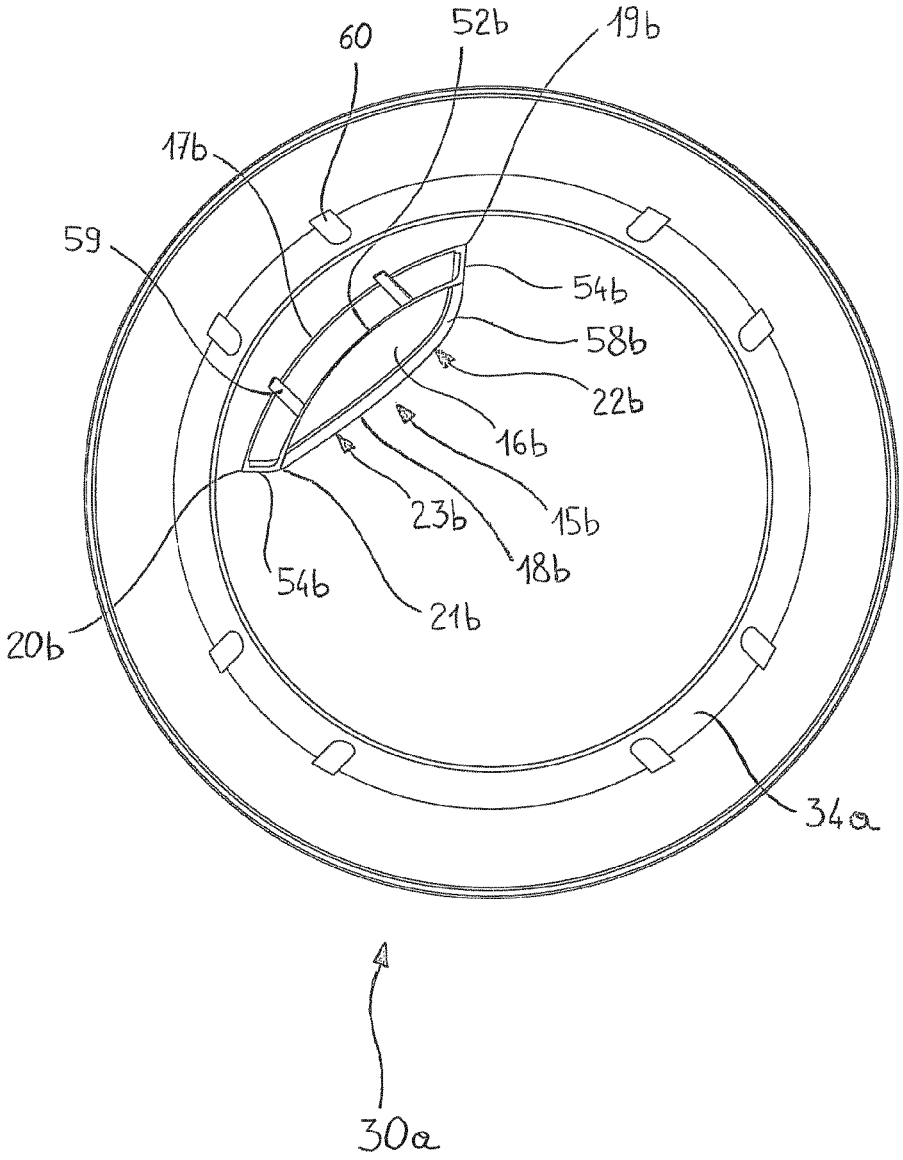
FIG. 16 shows a diagrammatic view, from the inside, of the frame and handle of FIG. 14.

In order to avoid having to manufacture and store different outer frames 30 with one piece handle 15, 15*a*, it is also possible to provide for a modified outer frame 30*a* and a detachable handle 15*b*, as shown in FIG. 14-16. FIG. 16 is schematic, and does not show several details as shown in FIGS. 9-11.

Besides the possibility of changing the position of the handle, this would also bring about other advantages, such as the possibility of easily changing the layout of the handle for different models of laundry machine 1 without having to provide different molds of the entire outer frame.

Outer frame 30*a* corresponds to the outer frame 30 already disclosed apart from what disclosed below.

Handle 15*b* advantageously includes a body portion 16*b* similar to body portion 16 of handle 15, advantageously including a zone 22*b* having a comparatively large radial extent and a zone 23*b* having a comparatively small radial extent, as well as a wall 52*b* extending along part of a cylindrical surface and lateral walls 54*b* one piece therewith, similar to walls 52, 54 just described. Wall 52*b* crosses body portion 16*b* at an intermediate zone thereof. The generally flat body portion 16*b* includes an arc of circumference edge 17*b* and a free edge 18*b* having the shape described above. The other parts of handle 15*b* are labeled similarly to the corresponding parts of handle 15, with a "b" suffix.

From the wall 52*b* extending along part of a cylindrical surface, a pair of bushings 59 advantageously protrudes, preferably generally radially, outwards, but extending parallel to each other and parallel to a median radial plane of the handle 15*b*. In the mounted condition of the handle 15*b*, the bushings 59 advantageously insert into bushings 60 having holes 61 that extend from the beveled inner circumferential edge 34*a* of outer frame 30*a*. Bushings 60 also advantageously protrude preferably generally radially outwards, but extending parallel to each other and parallel to a median radial plane defined centrally of the two bushings 60. Screws 62 or bolts advantageously retain the handle 15*b* to the outer frame 30*a* by passing through holes 61 and engaging bushings 59.

Outer frame 30*a* may include two or four series of holed bushings 60 as shown in FIGS. 14, 16 for mounting the handle 15*b* (or a handle having a mirror-image shape similar to that shown in FIGS. 7, 8).

The holes 61 that are not used for mounting the handle 15*b* may be advantageously covered with a cap. Alternatively, all the holes 61 may be covered by a thin membrane having a preferential rupture circumference, and during installation of the laundry machine 1, the membrane is removed only at the two holes 61 being actually used for mounting the handle 15*b*.

In the handles 15, 15*a*, 15*b*, the free edge 18, 18*a*, 18*b* of the body portion 16, 16*a*, 16*b* can have a thickening 58, 58*b*, preferably rounded, on the inner side of the handles 15, 15*a*, 15*b*.

The handle of the porthole can also be fixed, instead of with screws and threaded holes as just described, with snap action pins, or any other suitable system, in particular suitable coupling element(s) and matching coupling element(s).

Figure 17:
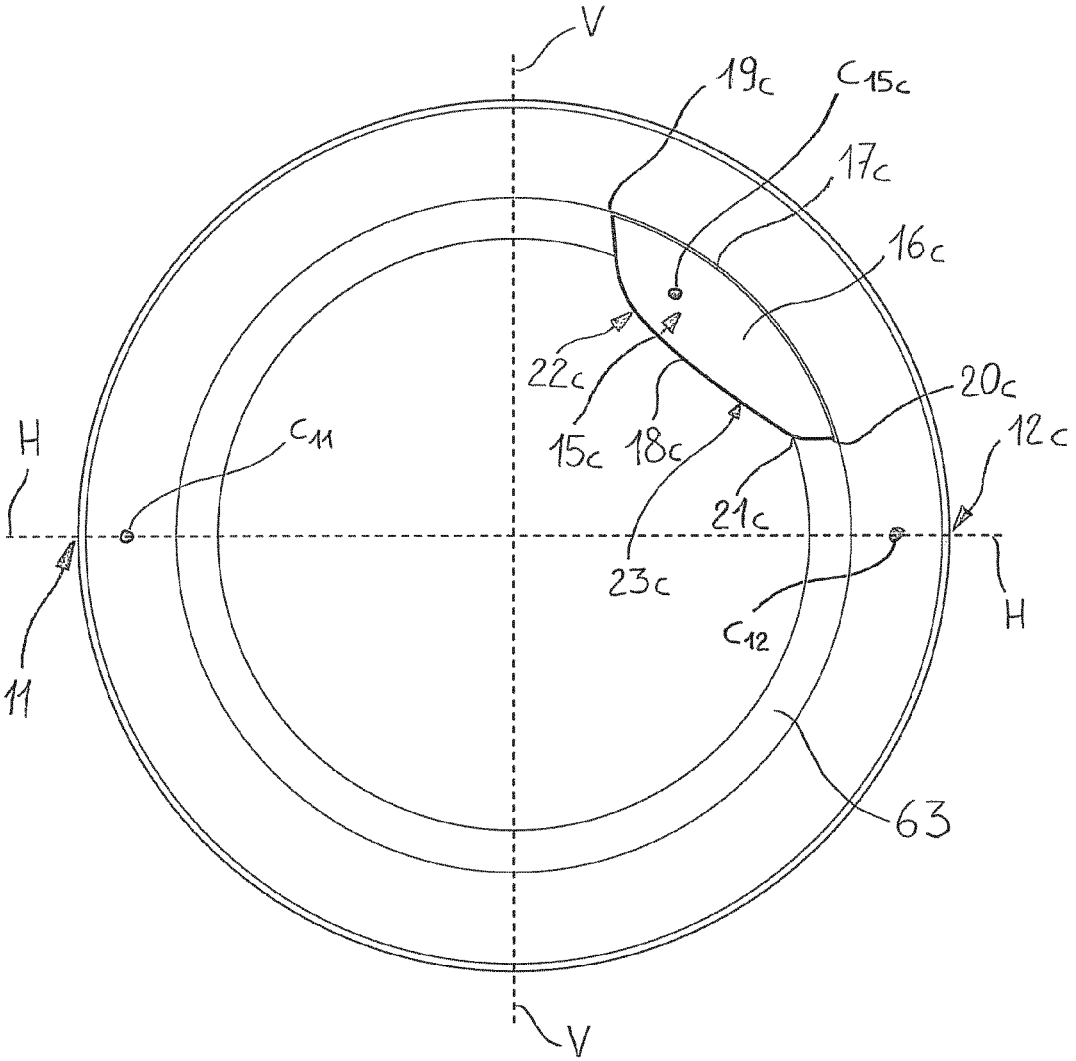
FIG. 17 shows a front view of an outer frame of a porthole and handle according to another embodiment of the invention, having a handle support.

With reference to FIG. 17, shoving a different advantageous embodiment of the invention, the position of the handle 15*c* may also be changed through a rotation of an annular handle support 63 to which handle 15*c* is fixed (for example handle 15*c* and annular handle support 63 may be a single body or one piece); in this case annular handle support 63 is advantageously sandwiched between the outer and inner frames 30, 30*a*, 31, and it is arranged in such a way that it can be mounted in at least two different angular positions with respect to outer frame 30, so that handle 15*c* is positionable in at least two prefixed positions by mounting annular handle support 63 in one of these at least two different angular positions. The other parts of handle 15*c* are labeled similarly to the corresponding parts of handle 15, with a "c" suffix.

Thus, the grip-only handle 15*b*, 15*c* is configured to be alternatively positionable in one of at least two prefixed positions with respect to the frame(s) 30, 30*a*, 31.

Moreover, said at least two prefixed positions are such that in any one of these prefixed positions, said grip-only handle 15*b*, 15*c*, when the porthole 8 is closed, has a different angular position with respect to the rotation axis RR.

Preferably, the prefixed positions of the grip-only handle 15*b*, 15*c* correspond to those described above with reference to grip-only handles 15, 15*a*.

The porthole can comprise only a single frame and a glass suitably fixed thereto, or even no glass and be one transparent or non-transparent part, being more properly called a door in the latter case.

The various disclosed features may be present individually or in any combination in a laundry machine according to aspects of the invention.

The invention claimed is:

1. A laundry machine comprising a cabinet housing a chamber for treating laundry having a rotation axis, a porthole for providing access to and tightly closing the chamber, a hinge to pivot the porthole to the cabinet, an electromechanical lock comprising a first member on the porthole and a matching member on the cabinet, and a grip-only handle, wherein said porthole comprises at least one frame and a glass secured to the at least one frame, wherein said electromechanical lock is an interlock configured to have a released position by applying a pulling force beyond a threshold onto the porthole away from the cabinet, wherein the electromechanical lock issues a signal to a control unit of the laundry machine when the electromechanical lock is in the released position, wherein the control unit controls an operating mode of the laundry machine in accordance with the signal issued from the electromechanical lock, wherein said grip-only handle and said first member of said electromechanical lock are arranged in such a way that, when the porthole is closed, a center of mass of said grip-only handle and a center of mass of said first member of said electromechanical lock are located, with respect to the rotation axis, at different angular positions.

2. The laundry machine of claim 1, wherein said hinge is arranged in such a way that, when the porthole is closed, its center of mass is located, with respect to the rotation axis, at a diametrically opposite angular position with respect to the center of mass of said first member of said electromechanical lock.

3. The laundry machine of claim 1, wherein said grip-only handle and said first member of said electromechanical lock are arranged in such a way that, when the porthole is closed, their centers of mass are located, with respect to the rotation axis, at angular positions that are reciprocally spaced by less than 90°.

4. The laundry machine of claim 1, wherein said grip-only handle is configured to be alternatively positionable in one of at least two prefixed positions with respect to said at least one frame.

5. The laundry machine of claim 1, wherein said grip-only handle is one piece with said at least one frame.

6. The laundry machine of claim 1, wherein said grip-only handle is one piece with an annular handle support that can be mounted in at least two different angular positions with respect to said at least one frame, so that said grip-only handle is positionable in said at least two prefixed positions by mounting said annular handle support in one of these at least two different angular positions.

7. The laundry machine of claim 1, wherein said grip-only handle is provided with a coupling element and said at least one frame is provided with a matching coupling element.

8. The laundry machine of claim 7, wherein said at least one frame is provided with a plurality of matching coupling elements so that said grip-only handle can be mounted in at least two different prefixed positions with respect to said at least one frame.

9. The laundry machine of claim 1, wherein said grip-only handle comprises a body portion that protrudes radially inwardly from the at least one frame and extends along an arc of a circumference, there being a wall of the handle or of the at least one frame crossing the body portion at an intermediate zone of the body portion, and a plurality of reinforcing ribs extending from the body portion and the wall.

10. The laundry machine of claim 9, wherein the ribs are generally L-shaped bodies arranged at a corner between the wall and the body portion, on the inner side of the grip-only handle facing, when the porthole is closed, said chamber and/or said cabinet.

11. The laundry machine of claim 10, wherein each rib includes a long edge adjoining an inner side of the body portion from the wall towards a free edge of the body portion, and a short edge adjoining at least part of the wall.

12. The laundry machine of claim 9, wherein the ribs extend parallel to each other.

13. The laundry machine of claim 1, wherein said grip-only handle protrudes radially inwardly from the at least one frame and extends along an arc of a circumference, the radial extent of the handle being not constant along said arc of a circumference and the handle comprising a zone having a first radial extent, and a zone adjacent thereto having a second radial extent smaller than the first radial extent, so that when the handle is gripped by a user, the zone having the first radial extent is gripped by the index finger and the medium finger, and the zone having the second radial extent is gripped by the ring finger and the little finger.

14. The laundry machine of claim 13, wherein said grip-only handle comprises a body portion having a first edge that is an arc of circumference and adjoins the at least one frame and a free edge that: contacts the first edge at a first end of the handle, is then curved, having a radially inner convexity so that the radial extent of the handle increases to a maximum and then decreases again to a minimum greater than zero at a corner near a second end of the handle, and after the corner is straight along an almost radial direction, until it contacts the first edge at the second end of the handle.

15. The laundry machine of claim 1, wherein said grip-only handle protrudes radially inwards from said at least one frame.

* * * * *